US011391174B2

(12) United States Patent
Little

(10) Patent No.: US 11,391,174 B2
(45) Date of Patent: Jul. 19, 2022

(54) VANE ARM CLIP FOR VARIABLE STATOR VANES

(71) Applicant: United Technologies Corporation, Farmington, CT (US)

(72) Inventor: Jonathan D. Little, West Hartford, CT (US)

(73) Assignee: Raytheon Technologies Corporation, Farmington, CT (US)

( * ) Notice: Subject to any disclaimer, the term of this patent is extended or adjusted under 35 U.S.C. 154(b) by 106 days.

(21) Appl. No.: 16/573,007

(22) Filed: Sep. 17, 2019

(65) Prior Publication Data

US 2021/0079806 A1 Mar. 18, 2021

(51) Int. Cl.

| | |
|---|---|
| ***F01D 17/16*** | (2006.01) |
| ***F01D 9/04*** | (2006.01) |
| ***F04D 29/56*** | (2006.01) |

(52) U.S. Cl.

CPC ..... *F01D 17/162* (2013.01); *F01D 9/042* (2013.01); *F04D 29/563* (2013.01); *F05D 2260/36* (2013.01); *F05D 2260/38* (2013.01); *F05D 2260/79* (2013.01)

(58) Field of Classification Search

CPC ..... F01D 17/14; F01D 17/162; F01D 9/042; F04D 29/563; F05D 2220/3218; F05D 2260/31; F05D 2260/36–38; F05D 2260/50; F05D 2260/79

USPC ..... 415/124.1, 140, 156, 160

See application file for complete search history.

(56) References Cited

U.S. PATENT DOCUMENTS

| | | | | |
|---|---|---|---|---|
| 5,024,580 | A | 6/1991 | Olive | |
| 6,799,945 | B2 | 10/2004 | Chatel et al. | |
| 7,011,494 | B2 * | 3/2006 | Kies | F01D 17/162 415/148 |
| 8,414,248 | B2 * | 4/2013 | Perez | F04D 29/563 415/1 |
| 10,208,618 | B2 | 2/2019 | Gasmen et al. | |
| 11,008,879 | B2 * | 5/2021 | Pratt | F04D 29/524 |
| 2020/0325792 | A1 * | 10/2020 | Pratt | F04D 29/563 |

* cited by examiner

*Primary Examiner* — Eldon T Brockman
*Assistant Examiner* — Danielle M. Christensen
(74) *Attorney, Agent, or Firm* — Bachman & LaPointe, P.C.

(57) ABSTRACT

A variable vane actuation system for a gas turbine engine includes a stem section, along an axis, the stem section includes a groove; a vane arm comprising a claw section received at least partially into the groove; a clip mounted to the claw section; and a fastener fastened to the stem section along the axis to retain the clip and the vane arm to the stem section.

16 Claims, 8 Drawing Sheets

VANE ARM CLIP FOR VARIABLE STATOR VANES

BACKGROUND

The present disclosure relates to a gas turbine engine and, more particularly, to a vane arm clip therefor.

Gas turbine engines, such as those that power modern commercial and military aircraft, generally include a compressor section to pressurize an airflow, a combustor section to burn a hydrocarbon fuel in the presence of the pressurized air, and a turbine section to extract energy from the resultant combustion gases.

Some gas turbine engines include variable stator vanes that can be pivoted about their individual axes to change an operational performance characteristic. Typically, the variable stator vanes are robustly designed to handle the stress loads that are applied to change the position of the vanes. A mechanical linkage is typically utilized to rotate the variable stator vanes. Because forces on the variable stator vanes can be relatively significant, forces transmitted through the mechanical linkage can also be relatively significant. Variable vanes are mounted about a pivot and are attached to an arm that is in turn actuated to adjust each of the vanes of a stage. A specific orientation between the arm and vane is required to assure that each vane in a stage is adjusted as desired to provide the desired engine operation. Newer compressor designs have resulted in higher compression ratios, loads and increased vane arm strength requirements that may be difficult to meet with sheet metal vane arm designs.

SUMMARY

A variable vane actuation system for a gas turbine engine according to one disclosed non-limiting embodiment of the present disclosure includes a stem section, along an axis, the stem section includes a groove; a vane arm comprising a claw section received at least partially into the groove; a clip mounted to the claw section; and a fastener fastened to the stem section along the axis to retain the clip and the vane arm to the stem section.

A further embodiment of any of the foregoing embodiments of the present disclosure includes that the clip comprises an aperture and the claw comprises an aperture along the axis.

A further embodiment of any of the foregoing embodiments of the present disclosure includes that the clip comprises a full hoop with a slot opposite the aperture, the slot fits into the groove.

A further embodiment of any of the foregoing embodiments of the present disclosure includes that the claw section comprises opposing fingers that are curved from an upper surface.

A further embodiment of any of the foregoing embodiments of the present disclosure includes that the opposing fingers each terminate at respective faces spaced from each other to define a claw opening received into the groove.

A further embodiment of any of the foregoing embodiments of the present disclosure includes that a vane is rotatable about the axis.

A further embodiment of any of the foregoing embodiments of the present disclosure includes that the stem extends from an outer trunion of the vane.

A further embodiment of any of the foregoing embodiments of the present disclosure includes that the vane comprises an airfoil.

A further embodiment of any of the foregoing embodiments of the present disclosure includes that the clip is mounted to the claw section via an interference fit.

A further embodiment of any of the foregoing embodiments of the present disclosure includes that the clip is manufactured of sheet metal that is between 40-70 mils (1.0-1.8 mm) thick.

A further embodiment of any of the foregoing embodiments of the present disclosure includes that the stem section extends from a vane through an engine case.

A method of assembling a variable vane actuation system according to one disclosed non-limiting embodiment of the present disclosure includes locating a clip at least partially around a claw section of a vane arm.

A further embodiment of any of the foregoing embodiments of the present disclosure includes that locating the clip at least partially around the claw section provides an interference fit between the clip and the claw section.

A further embodiment of any of the foregoing embodiments of the present disclosure includes retaining the clip to the claw section via a bolt threaded into a threaded bore of a stem section of a vane.

A further embodiment of any of the foregoing embodiments of the present disclosure includes threading the bolt into the threaded bore along an axis of rotation of the stem section.

A further embodiment of any of the foregoing embodiments of the present disclosure includes locating the claw section at least partially into a groove in the stem section prior to locating the clip at least partially around the claw section.

A further embodiment of any of the foregoing embodiments of the present disclosure includes locating the clip at least partially into the groove in the stem section.

A further embodiment of any of the foregoing embodiments of the present disclosure includes that locating the clip at least partially into the groove in the stem section transverse to an axis of rotation of the stem section.

The foregoing features and elements may be combined in various combinations without exclusivity, unless expressly indicated otherwise. These features and elements as well as the operation thereof will become more apparent in light of the following description and the accompanying drawings. It should be appreciated; however, the following description and drawings are intended to be exemplary in nature and non-limiting.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
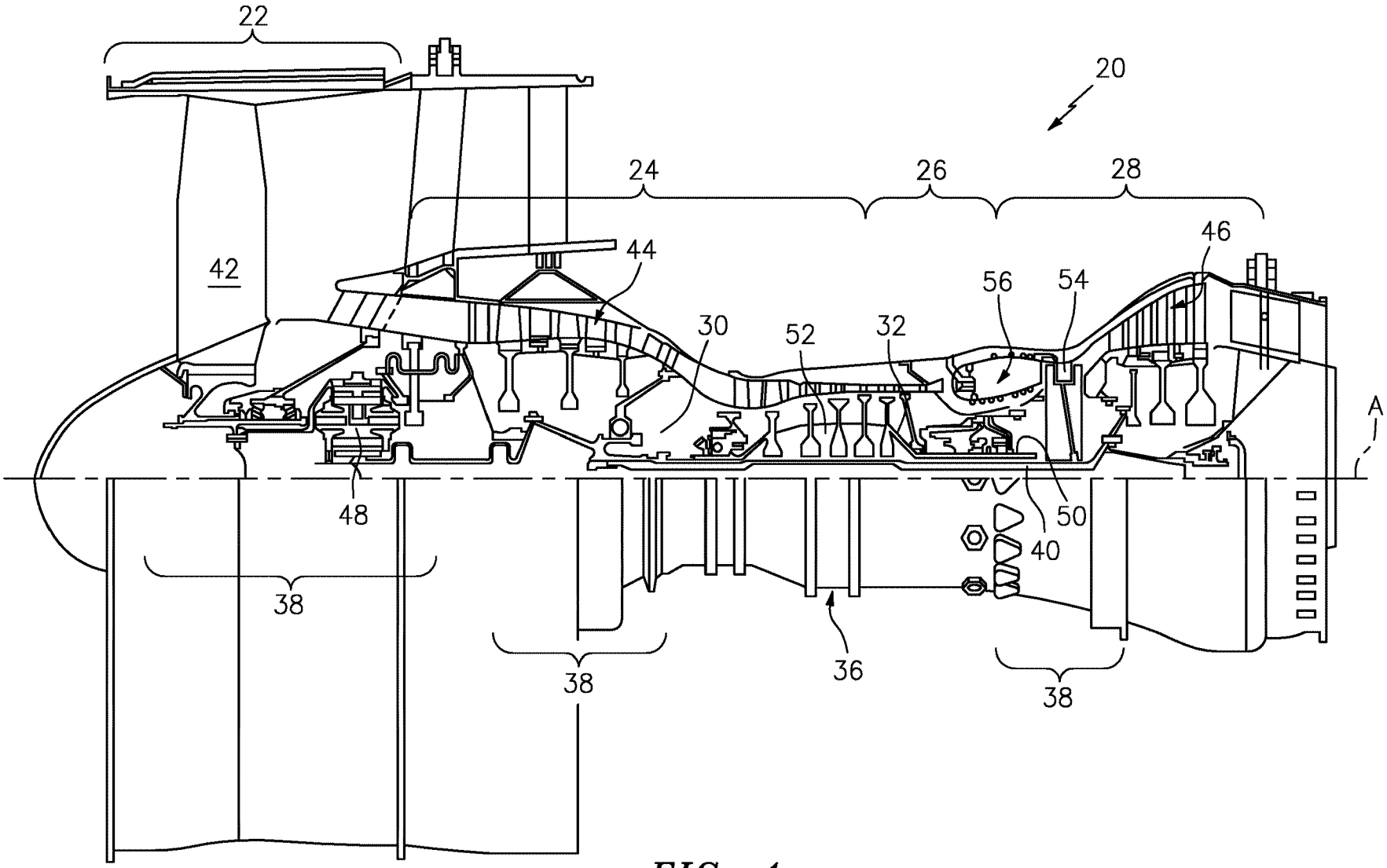
FIG. 1 is a schematic cross-section of an example gas turbine engine architecture.

FIG. 1 schematically illustrates a gas turbine engine 20. The gas turbine engine 20 is disclosed herein as a two-spool GTF (geared turbofan) that generally incorporates a fan section 22, a compressor section 24, a combustor section 26 and a turbine section 28. Alternative engine architectures might include an augmentor section and exhaust duct section (not shown) among other systems or features. The fan section 22 drives air along a bypass flowpath while the compressor section 24 drives air along a core flowpath for compression and communication into the combustor section 26 then expansion thru the turbine section 28. Although depicted as a GTF in the disclosed non-limiting embodiment, it should be understood that the concepts described herein are not limited to use with GTF as the teachings may be applied to other types of turbine engines such as a Direct-Drive-Turbofan with high, or low bypass augmented turbofan, turbojets, turboshafts, and three-spool (plus fan) turbofans wherein an intermediate spool includes an intermediate pressure compressor ("IPC") between a Low Pressure Compressor ("LPC") and a High Pressure Compressor ("HPC"), and an intermediate pressure turbine ("IPT") between the high pressure turbine ("HPT") and the Low pressure Turbine ("LPT").

The engine 20 generally includes a low spool 30 and a high spool 32 mounted for rotation about an engine central longitudinal axis A relative to an engine static structure 36 via several bearing compartments 38. The low spool 30 generally includes an inner shaft 40 that interconnects a fan 42, a low pressure compressor 44 ("LPC") and a low pressure turbine 46 ("LPT"). The inner shaft 40 drives the fan 42 directly or thru a geared architecture 48 to drive the fan 42 at a lower speed than the low spool 30. An exemplary reduction transmission is an epicyclic transmission, namely a planetary or star gear system.

The high spool 32 includes an outer shaft 50 that interconnects a high pressure compressor 52 ("HPC") and high pressure turbine 54 ("HPT"). A combustor 56 is arranged between the HPC 52 and the HPT 54. The inner shaft 40 and the outer shaft 50 are concentric and rotate about the engine central longitudinal axis A which is collinear with their longitudinal axes.

Core airflow is compressed by the LPC 44 then the HPC 52, mixed with fuel and burned in the combustor 56, then expanded over the HPT 54 and the LPT 46. The turbines 54, 46 rotationally drive the respective low spool 30 and high spool 32 in response to the expansion. The main engine shafts 40, 50 are supported at a plurality of points by the bearing compartments 38. It should be understood that various bearing compartments 38 at various locations may alternatively or additionally be provided.

In one example, the gas turbine engine 20 is a high-bypass geared aircraft engine with a bypass ratio greater than about six (6:1). The geared architecture 48 can include an epicyclic gear train, such as a planetary gear system or other gear system. The example epicyclic gear train has a gear reduction ratio of greater than about 2.3:1, and in another example is greater than about 3.0:1. The geared turbofan enables operation of the low spool 30 at higher speeds which can increase the operational efficiency of the LPC 44 and LPT 46 to render increased pressure in relatively few stages.

A pressure ratio associated with the LPT 46 is pressure measured prior to the inlet of the LPT 46 as related to the pressure at the outlet of the LPT 46 prior to an exhaust nozzle of the gas turbine engine 20. In one non-limiting embodiment, the bypass ratio of the gas turbine engine 20 is greater than about ten (10:1), the fan diameter is significantly larger than that of the LPC 44, and the LPT 46 has a pressure ratio that is greater than about five (5:1). It should be understood, however, that the above parameters are only exemplary of one embodiment of a geared architecture engine and that the present disclosure is applicable to other gas turbine engines including direct drive turbofans, where the rotational speed of the fan 42 is the same (1:1) of the LPC 44.

In one example, a significant amount of thrust is provided by the bypass flow path due to the high bypass ratio. The fan section 22 of the gas turbine engine 20 is designed for a particular flight condition—typically cruise at about 0.8 Mach and about 35,000 feet (10668 meters). This flight condition, with the gas turbine engine 20 at its best fuel consumption, is also known as bucket cruise Thrust Specific Fuel Consumption (TSFC). TSFC is an industry standard parameter of fuel consumption per unit of thrust.

Fan Pressure Ratio is the pressure ratio across a blade of the fan section 22 without the use of a Fan Exit Guide Vane system. The relatively low Fan Pressure Ratio according to one example gas turbine engine 20 is less than 1.45. Low Corrected Fan Tip Speed is the actual fan tip speed divided by an industry standard temperature correction of $(\text{"T"}/518.7)^{0.5}$ in which "T" represents the ambient temperature in degrees Rankine. The Low Corrected Fan Tip Speed according to one example gas turbine engine 20 is less than about 1150 fps (351 m/s).

Figure 2:
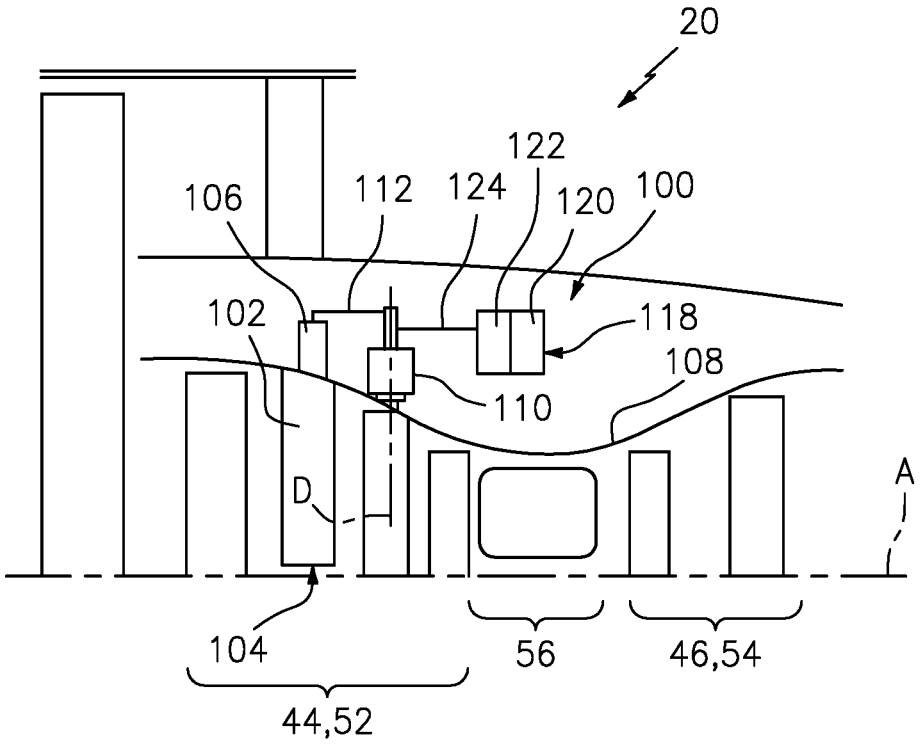
FIG. 2 is a schematic view of a variable vane system for a gas turbine engine.

With reference to FIG. 2, one or more stages of the LPC 44 and/or the HPC 52 include a variable vane system 100 that can be rotated to change an operational performance characteristic of the gas turbine engine 20 for different operating conditions. The variable vane system 100 may include one or more variable vane stages.

The variable vane system 100 may include a plurality of variable stator vanes 102 (also shown in FIG. 3) circumferentially arranged around the engine central axis A. The variable stator vanes 102 each include a variable vane body that has an airfoil portion such that one side of the airfoil portion generally operates as a suction side and the opposing side of the airfoil portion generally operates as a pressure side. Each of the variable stator vanes 102 generally spans between an inner diameter and an outer diameter relative to the engine central axis A.

Figure 3:
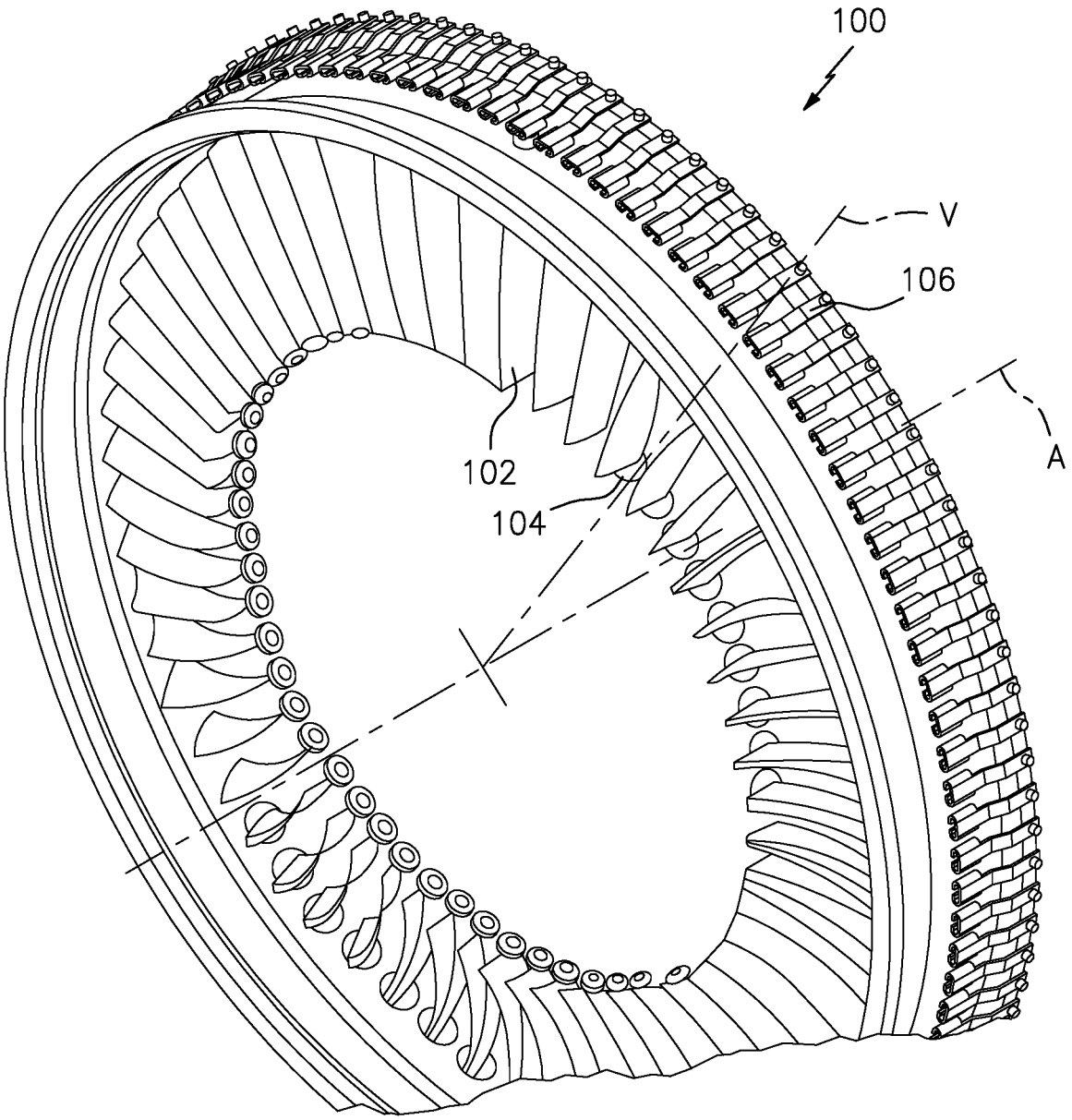
FIG. 3 is a partial perspective view of one stage of a variable vane system for a gas turbine engine.

Each of the variable stator vanes 102 includes an inner trunion 104 that is receivable into a corresponding socket and an outer trunion 106 mounted through an outer engine case 108 such that each of the variable stator vanes 102 can pivot about a vane axis V (FIG. 3).

The variable vane system 100 further includes a synchronizing ring assembly 110 to which, in one disclosed non-limiting embodiment, each of the outer trunions 106 are attached through a vane arm 112 along a respective axis D. It should be appreciated that although a particular vane arm 112 is disclosed in this embodiment, various linkages of various geometries may be utilized.

Figure 4:
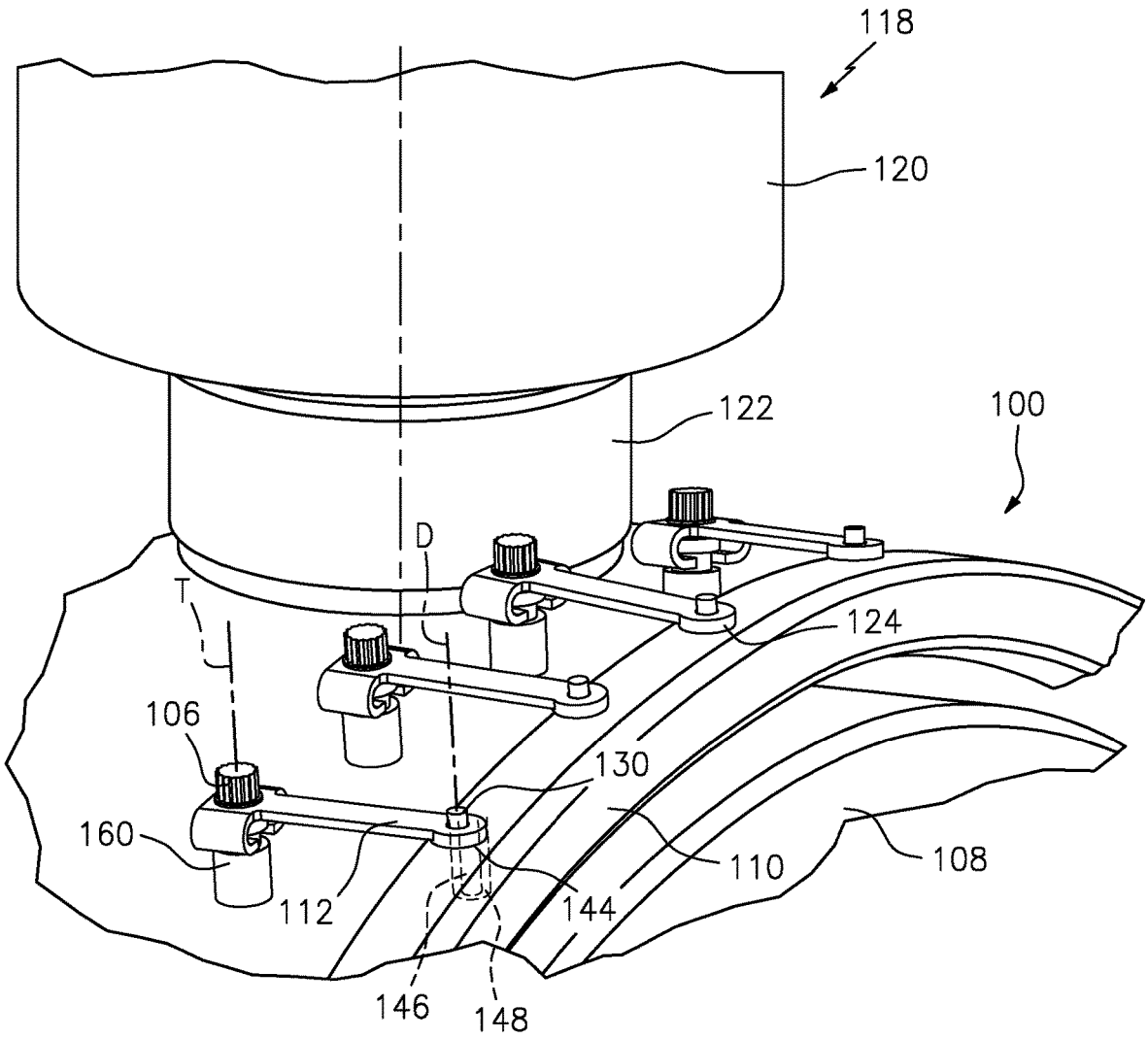
FIG. 4 is a partial perspective view of a variable vane system for a gas turbine engine according to one disclosed non-limiting embodiment.

The variable vane system 100 is driven by an actuator system 118 with an actuator 120, a drive 122 and an actuator arm 124 (also shown in FIG. 4). Although particular components are separately described, it should be appreciated that alternative or additional components may be provided.

With reference to FIG. 4, the vane arm 112 links each outer trunion 106 to the synchronizing ring assembly 110. Rotation of the synchronizing ring assembly 110 about the engine axis A (FIG. 1) drives the vane arm 112 to rotate the outer trunion 106 of each of the variable stator vanes 102.

Each vane arm 112 interfaces with the synchronizing ring assembly 110 via a pin 130. The pin 130 is swaged to an end section 140 of the vane arm 112 within an aperture 142. A collar 144 of the pin 130 may be utilized to locate the pin 130 at an appropriate depth prior to swaging. The pin 130 is received within a bushing 146 that fits within a sleeve 148 in the synchronizing ring assembly 110. The bushing 146 permits the pin 130 and the vane arm 112 to rotate together relative to the synchronizing ring assembly 110.

Figure 5:
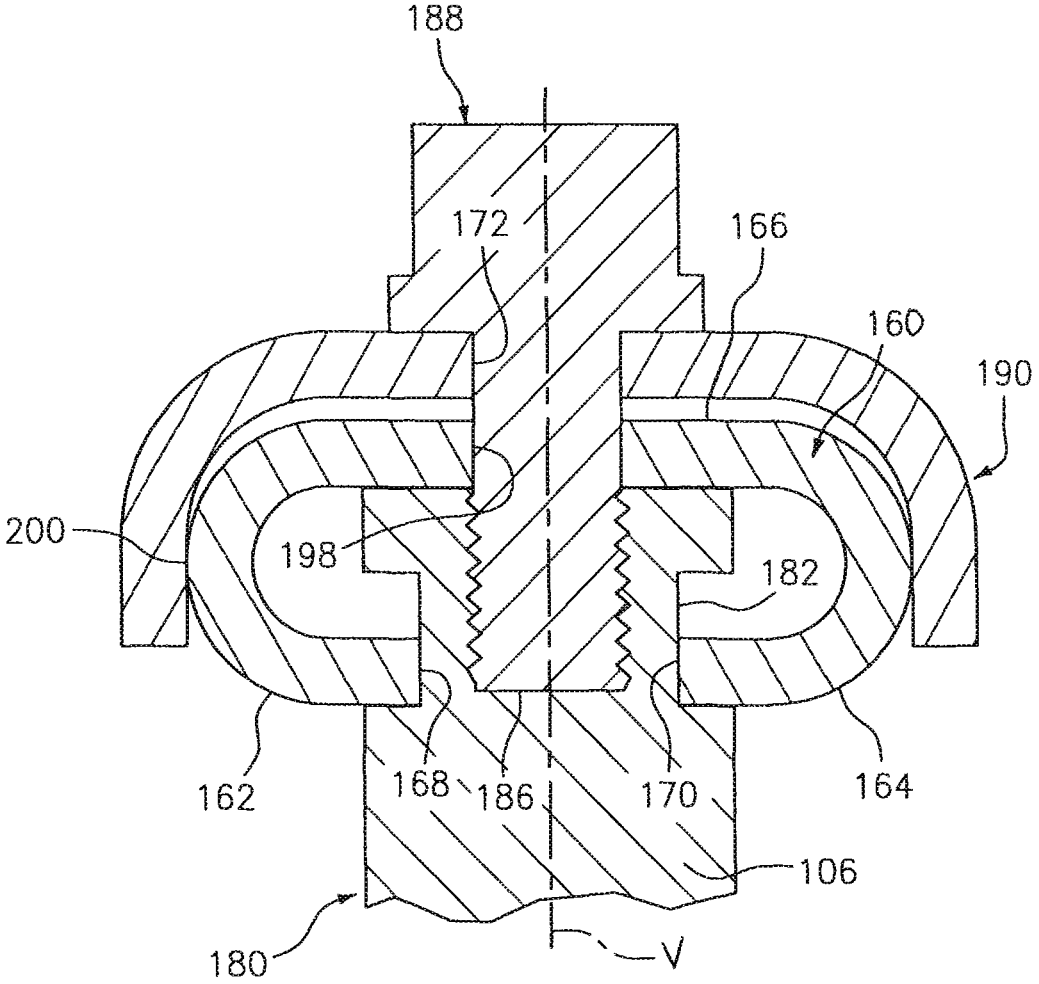
FIG. 5 is a sectional view of an interface between a one variable vane and a vane arm with the clip of FIG. 7 according to one disclosed non-limiting embodiment.
Figure 6:
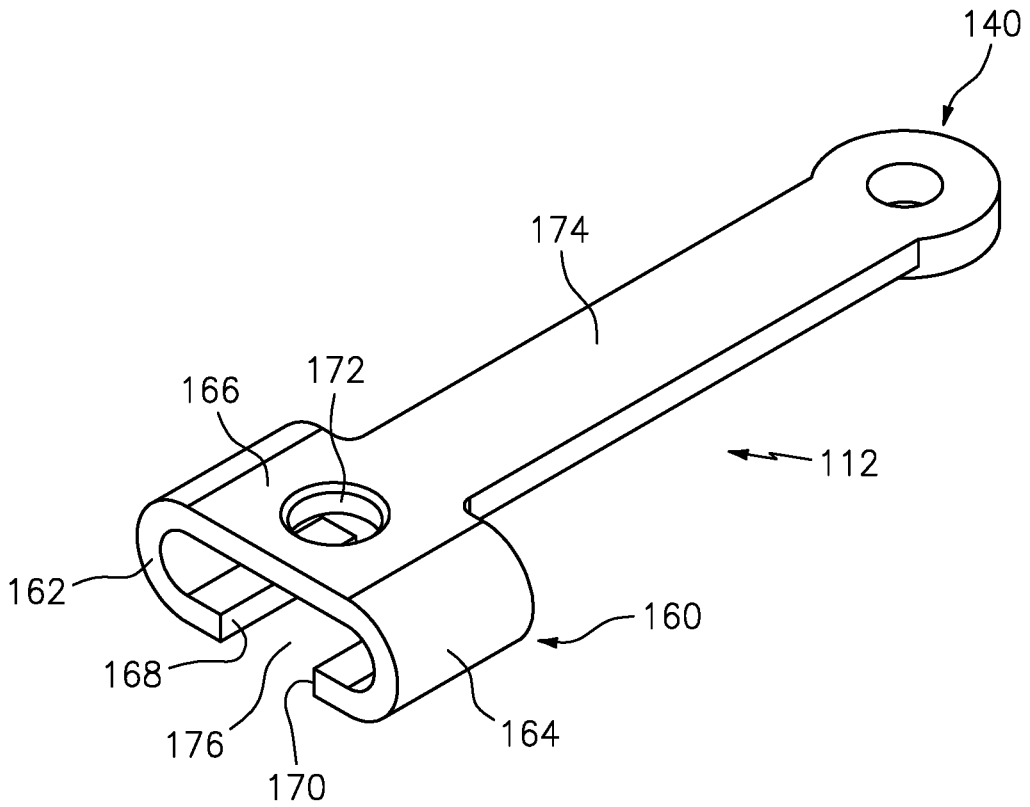
FIG. 6 is a perspective view of a vane arm according to one disclosed non-limiting embodiment.

With reference to FIG. 5, each vane arm 112 (FIG. 6) also interfaces with its respective stator vane 102 via a claw section 160 opposite the end section 140 to rotate the outer trunion 106. The claw section 160 includes opposing fingers 162, 164 that are curved from an upper surface 166 and terminate at respective opposed faces 168, 170. The upper surface 166 extends from an arm 174 and includes an aperture 172. Each vane arm 112 may be manufactured of a sheet metal material that is between 40-70 mils (1.0-1.8 mm) thick. The opposed faces 168, 170 are spaced to provide an opening 176 that interfaces with the outer trunion 106.

The outer trunion 106 includes a stem section 180 that forms a groove 182. An outer diameter of the stem section 180 is greater than the diameter of the groove 182. A threaded bore 186 is defined through the outer trunion 106 along the axis T.

Figure 7:
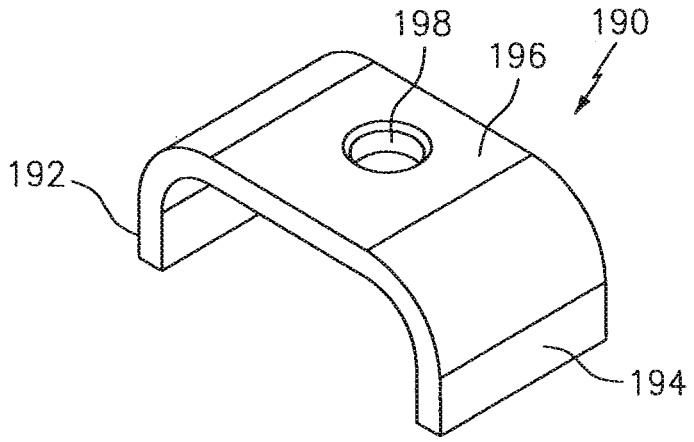
FIG. 7 is a perspective view of a vane arm clip according to one disclosed non-limiting embodiment.

A clip 190 (FIG. 7) includes opposing arms 192, 194 that are curved from a clip upper surface 196 to be essentially perpendicular thereto. The clip upper surface 196 includes a clip aperture 198 that corresponds with the aperture 172. That, is the clip 190 is essentially bracket shaped to fit over the claw section 160 (FIG. 7). The clip 190 may be manufactured of nickel sheet metal that is between 40-70 mils (1.0-1.8 mm) thick.

The threaded bore 186 receives a bolt 188 that retains the clip 190 and the vane arm 112 to the outer trunion 106 such that opposed faces 168, 170 engage the groove 182. That is, the bolt 188 extends through the clip aperture 198 and the aperture 172, then threads into the threaded bore 186 along axis T.

The clip 190 may be fitted to the claw section 160 via an interference fit 200 across the opposing fingers 162, 164 to provide strength during all operating conditions or fitted with small clearance fit to provide additional strength only in a high load situation such as a surge condition. The clip 190 provides strength much like a leaf spring.

Figure 8:
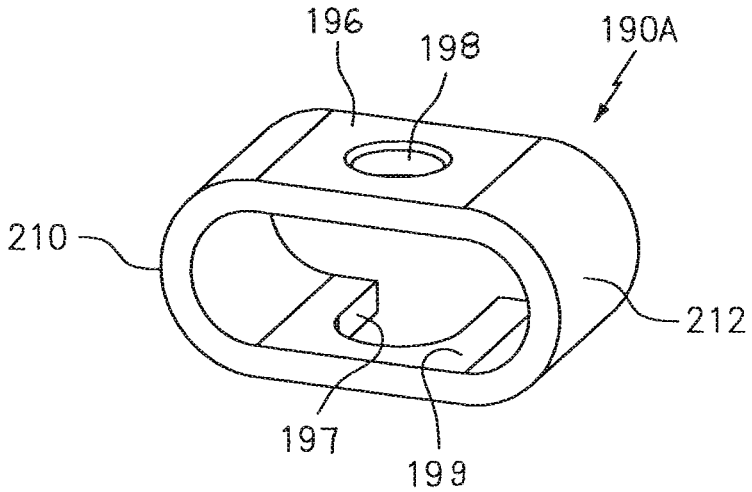
FIG. 8 is a perspective view of a vane arm clip according to another disclosed non-limiting embodiment.
Figure 9:
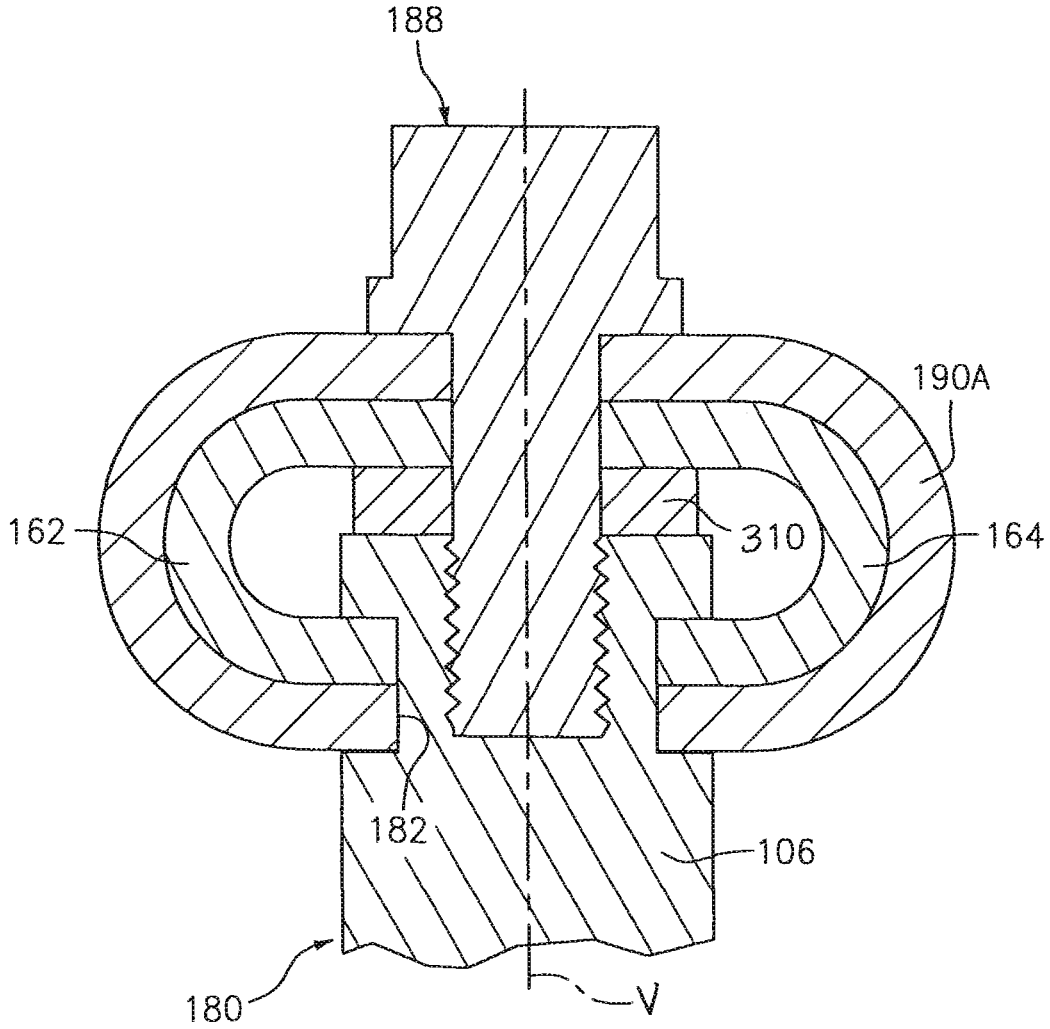
FIG. 9 is a sectional view of an interface between one variable vane and a vane arm with the clip of FIG. 8.

With reference to FIG. 8, a clip 190A according to another embodiment is a full hoop. The clip 190A includes a clip aperture 198 in an upper surface 196 and a slot 197 in a lower surface 199. The upper surface 196 and the lower surface 199 include radiused arms 210, 212 therebetween that fit around the opposing fingers 162, 164 (FIG. 9).

The clip aperture 198 receives the bolt 188 and the slot fits into the groove 182. In this embodiment, the clip 190A is installed transverse to the axis T. The clip 190A thereby provides full circumferential support to the claw section 160. A spacer 310 may be provided for clearance.

The clip 190, 190A provides strength to the claw section 160 much like a leaf spring. The clip 190, 190A is inexpensive and relatively easy to manufacture that significantly supplements the strength of existing sheet metal vane arm design. In addition, as the clip is assembled to the vane arm, the clip 190, 190A provides resistance to rotation caused by run on torque assembly forces.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason, the appended claims should be studied to determine true scope and content.

What is claimed is:

1. A variable vane actuation system for a gas turbine engine, comprising:

a stem section, along an axis, the stem section includes a groove;

a vane arm comprising a claw section received at least partially into the groove;

a clip mounted to the claw section, wherein the clip has opposing arms curved from a clip upper surface to laterally engage the claw section of the vane arm the clip at least partially received into the groove; and a fastener fastened to the stem section along the axis to retain the clip and the vane arm to the stem section.

2. The system as recited in claim 1, wherein the clip comprises an aperture and the claw comprises an aperture along the axis.

3. The system as recited in claim 1, wherein the clip comprises a full hoop with a slot opposite the aperture, the slot fits into the groove.

4. The system as recited in claim 1, wherein the claw section comprises opposing fingers that are curved from an upper surface and wherein the arms of the clip laterally engage the fingers of the claw section.

5. The system as recited in claim 4, wherein the opposing fingers each terminate at respective faces spaced from each other to define a claw opening received into the groove.

6. The system as recited in claim 1, wherein a vane is rotatable about the axis.

7. The system as recited in claim 6, wherein the stem section extends from an outer trunion of the vane.

8. The system as recited in claim 7, wherein the vane comprises an airfoil.

9. The system as recited in claim 1, wherein the clip is mounted to the claw section via an interference fit.

10. The system as recited in claim 1, wherein the clip is manufactured of sheet metal that is between 40-70 mils (1.0-1.8 mm) thick.

11. The system as recited in claim 10, wherein the stem section extends from a vane through an engine case.

12. A method of assembling a variable vane actuation system, comprising:

locating a clip at least partially around a claw section of a vane arm wherein the clip has arms that are curved from a clip upper surface to laterally engage the claw section, further comprising locating the claw section at least partially into a groove in the stem section prior to locating the clip at least partially around the claw section, and locating the clip at least partially into the groove in the stem section.

13. The method as recited in claim 12, wherein locating the clip at least partially around the claw section provides an interference fit between the clip and the claw section.

14. The method as recited in claim 12, further comprising retaining the clip to the claw section via a bolt threaded into a threaded bore of a stem section of a vane.

15. The method as recited in claim 14, further comprising threading the bolt into the threaded bore along an axis of rotation of the stem section.

16. The method as recited in claim 12, wherein locating the clip at least partially into the groove in the stem section transverse to an axis of rotation of the stem section.

* * * * *